US012358597B1

(12) United States Patent
Shi

(10) Patent No.: US 12,358,597 B1
(45) Date of Patent: Jul. 15, 2025

(54) INFLATABLE RAFT

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

(21) Appl. No.: 19/062,137

(22) Filed: Feb. 25, 2025

(51) Int. Cl.
*B63B 34/52* (2020.01)
*B63B 17/02* (2006.01)
*B63B 34/565* (2020.01)

(52) U.S. Cl.
CPC ..... *B63B 34/52* (2020.02); *B63B 17/02* (2013.01); *B63B 34/565* (2020.02)

(58) Field of Classification Search
CPC ..... B63B 34/52; B63B 34/565; B63B 17/02
USPC ..... 114/345; 441/40–42, 129–132
See application file for complete search history.

(56) References Cited

U.S. PATENT DOCUMENTS 4,861,301 A * 8/1989 Pomeroy ..... B63B 34/52 224/406
4,968,278 A * 11/1990 Lemke ..... B63B 35/00 D12/316
5,507,674 A * 4/1996 Yeung ..... B63B 34/52 441/131
6,171,160 B1 * 1/2001 Skaggs ..... B63B 22/24 441/136
D538,877 S * 3/2007 Peterson ..... D21/803
7,195,132 B1 * 3/2007 Balam ..... A47G 23/02 383/3
10,946,943 B2 * 3/2021 Builder ..... B63B 35/34
11,667,354 B2 * 6/2023 Gormley ..... B63B 21/08 114/343
12,102,245 B2 * 10/2024 Rietema ..... A47G 23/0216
2004/0038603 A1 * 2/2004 Gaspar ..... A47C 15/006 441/130
2020/0339229 A1 * 10/2020 Leonard ..... B63B 34/565

FOREIGN PATENT DOCUMENTS

KR 20160099945 A * 2/2015

* cited by examiner

*Primary Examiner* — Ajay Vasudeva
(74) *Attorney, Agent, or Firm* — Cooper Legal Group, LLC

(57) ABSTRACT

An inflatable raft includes at least one raft body and at least one floating bed, a connection assembly is provided between each floating bed and a respective on raft body, an ice bucket is provided on each floating bed, the connection assembly includes two snap rings, two tension straps and two locking buckles, the two snap rings are respectively provided on a side wall of each floating bed and a side wall of the respective one raft body, a first end of each of the two tension straps is fixed to one of the two snap rings, a second end of each of the two tension straps is fixed to one of the two locking buckles, and the two locking buckles are interlocked with each other.

8 Claims, 5 Drawing Sheets

A

A

INFLATABLE RAFT

TECHNICAL FIELD

The present disclosure relates to the field of inflatable rafts and combination devices thereof, and in particular, to an inflatable raft.

BACKGROUND ART

An inflatable raft is widely used in outdoor leisure life, especially in the field of water entertainment facilities such as a floating bed and a lifeboat. With people's continuous pursuit of quality of life, the demand for outdoor leisure equipment is also gradually increasing. These devices not only need to have basic security performance, but also need to provide more convenient and comfort use to meet diverse needs of users. Therefore, how to improve the multifunctionality and convenience of the devices while ensuring safety has become an important research topic at present.

In existing technology, in order to enhance the multifunctionality of the inflatable raft, it is a commonly adopted method that various accessories are added to the inflatable raft. For example, by adding accessories such as a cup holder and a storage basket on the inflatable raft, it is convenient for users to place beverages and other items during use. In addition, by some designs a sunshade is retrofitted on the inflatable raft to provide a sheltered function from the sun and rain. Although these methods may improve user experience to a certain extent, there are still many limitations.

The inflatable raft in the existing technology generally faces issues of unstable connection and poor stability when adding accessories. Especially when the accessories are relatively heavy, it is prone to cause uneven force distribution on the inflatable raft, thereby affecting the structural stability of an entire device. Traditional connection methods mostly rely on simple buckles or straps, these connection methods are prone to loosening or falling off in complex usage environments, seriously affecting reliability and user experience of the devices.

SUMMARY

In order to address the technical problem mentioned above, the present application provides an inflatable raft.

The inflatable raft provided in the present application includes at least one raft body and at least one floating bed, connection assemblies are provided between each of the at least one floating bed and two adjacent raft bodies, an ice bucket is provided on each of the at least one floating bed, the connection assembly includes two snap rings, two tension straps and two locking buckles, the two snap rings are respectively provided on a side wall of each of the at least one floating bed and a side wall of the respective one of the at least one raft body, a first end of each of the two tension straps is fixed to one of the two snap rings, a second end of each of the two tension straps is fixed to one of the two locking buckles, and the two locking buckles are interlocked with each other.

By adopting the above technical solution, by the inflatable raft flexible connections between a plurality of raft bodies may be achieved while ensuring a stable holding of the ice bucket. Specifically, the design of the connection assembly between the floating bed and raft body makes the entire structure more stable, which avoids separation or displacement caused by external impacts during use. In addition, a double fixing manner of the snap ring, the tension strap and the locking buckle further enhances the connection reliability and safety. This design not only improves the service life of the product, but also improves the user experience.

Optionally, each of the at least one raft body is provided with an awning, the awning includes two mounting rods, two first fiber rods and a PVC sheet, the two mounting rods are each configured in an arc shape, two ends of each of the two mounting rods are respectively fixed on two sides of the raft body, the two first fiber rods encase the two mounting rod respectively, and the PVC sheet is fixed to the two first fiber rods.

By adopting the above technical solution, by means of the inflatable raft rainwater may be effectively prevented from entering while providing a certain level of privacy protection. The design of the awning not only increases the aesthetic appeal of the product, but also improves the comfort of use. Specifically, the arc-shaped design of the mounting rod makes the awning more stable, so as to better adapt to various environmental conditions. The first fiber rod encases the mounting rod, which enhances the structural stability and the durability, while by using the PVC sheet the shielding effect is further improved, which ensures a good waterproof performance.

Optionally, the awning further includes a second fiber rod, two ends of the second fiber rod are respectively inserted into side walls of the two first fiber rods, and the second fiber rod is located in a middle of an arc-shaped surface of the awning to form a support.

By adopting the above technical solution, the two ends of the second fiber rod are respectively inserted into the side walls of the two first fiber rods, and are located in the middle of the arc-shaped surface of the awning to form a support, which enhances the overall structural stability of the awning and improves its wind resistance and service life.

Optionally, an installation assembly is provided between each of the two mounting rods and a respective one of the at least one raft body, the installation assembly includes a mounting base and a socket, the mounting base is fixed to the side wall of the respective one of the at least one raft body, the socket is fixed to a side wall of the mounting base, and each of the two mounting rods is inserted into the socket.

By adopting the above technical solution, fast and convenient assembly and disassembly may be achieved by means of the installation assembly between the mounting rod and the raft body, so as to improve the use flexibility and maintenance convenience of the inflatable raft. Specifically, the mounting base is fixed to the side wall of the raft body, the socket is fixed to the side wall of the mounting base, and the mounting rod is inserted into the socket to simplify and expedite the installation process while ensuring the stability and reliability of the structure. This design not only simplifies the operation process of the user, but also facilitates a quick replacement or reparation when needed, thereby improving the user experience.

Optionally, the installation assembly further includes a cover plate, the cover plate is hinged to the mounting base, and the cover plate covers the socket and the respective one of the two mounting rods.

By adopting the above technical solution, the cover plate is hinged to the mounting base and may fully cover the outer sides of the socket and the mounting rod when being closed, which effectively prevents external impurities from entering the interior of the socket, thereby improving the stability and service life of the installation assembly. At the same time, a closure design of the cover plate also improves an overall aesthetics of the installation assembly.

Optionally, the mounting base is provided with a plurality of sets of first locking blocks, each set of the plurality of sets of first locking blocks is provided with two first locking blocks, and side walls of the two first locking blocks respectively abut against two sides of the respective one of the two mounting rods to clamp the respective one of the two mounting rods.

By adopting the above technical solution, the first locking blocks on the mounting base may effectively clamp the mounting rod, so as to firmly fix the mounting rod on the raft body, thereby preventing the mounting rod from loosening due to external vibration or wind force, and thus improving an overall stability and reliability of the awning.

Optionally, the cover plate is provided with a plurality of sets of second locking blocks, each set of the plurality of sets of second locking blocks is provided with two second locking blocks, and when the cover plate covers the mounting base, side walls of the two second locking blocks respectively abut against two sides of the respective one of the two mounting rods to clamp the respective one of the two mounting rods.

By adopting the above technical solution, the second locking blocks on the cover plate may effectively clamp the mounting rod, to ensure the stability and firmness of the mounting rod inside the mounting base, thereby preventing the mounting rod from loosening and falling off due to external vibration or impact, and thus improving the overall structural stability of the inflatable raft. At the same time, the design of the second locking block simplifies and expedites the installation and disassembly of the mounting rod, which improves the user experience.

Optionally, the awning further includes two fiberboards, the two fiberboards are fixed to the two first fiber rods, the mounting base is provided with a hook, the fiberboard is fixed with a hanging ring, and the hook is hooked on the hanging ring.

By adopting the above technical solution, the awning is further provided with the fiberboard, which is fixed to the first fiber rod, thereby improving the overall structural stability of the awning. Additionally, the installation of the awning is more convenient by hooking the hook on the mounting base onto the hanging ring on the fiberboard, which improves the user experience.

Optionally, left and right side walls of the raft body are embedded with cup holders.

By adopting the above technical solution, the inflatable raft is provided with cup holders on two sides of the raft body, which may facilitate users to place beverages or small items, thereby improving the convenience and comfort of use.

Optionally, a top of the raft body is provided with a cushion, and an angle of the cushion is adjustable.

By adopting the above technical solution, the top of the raft body is provided with the cushion, and the angle of the cushion is adjustable, which may effectively improve the comfort of users, such that users may adjust the angle of the cushion according to their personal needs during use, thereby obtaining a more comfortable experience.

Optionally, two or more floating beds are provided, and two or more raft bodies are provided.

In summary, the present application includes at least one of the following beneficial technical effects:

1. By providing the connection assembly between the floating bed and the raft body, which includes the snap ring, the tension strap and the locking buckle, the stability and reliability of the inflatable raft may be effectively improved, solves the problem that loosening or falling off may easily occur by the traditional connection manner, thereby ensuring the structural stability of the device in a complex usage environment.
2. The floating bed carries ice buckets, which not only enhances the multifunctionality of the inflatable raft, but also improves the user experience, making it more convenient for users to enjoy cold drinks during outdoor activities.
3. The awning is provided on the raft body, an effective sheltering from the sun and rain may be achieved through a combination of the mounting rod, the first fiber rod and the PVC sheet, which further improves the comfort and practicality of outdoor leisure devices, thereby meeting pursuit of diverse needs of users.

DETAILED DESCRIPTION

Figure 1:
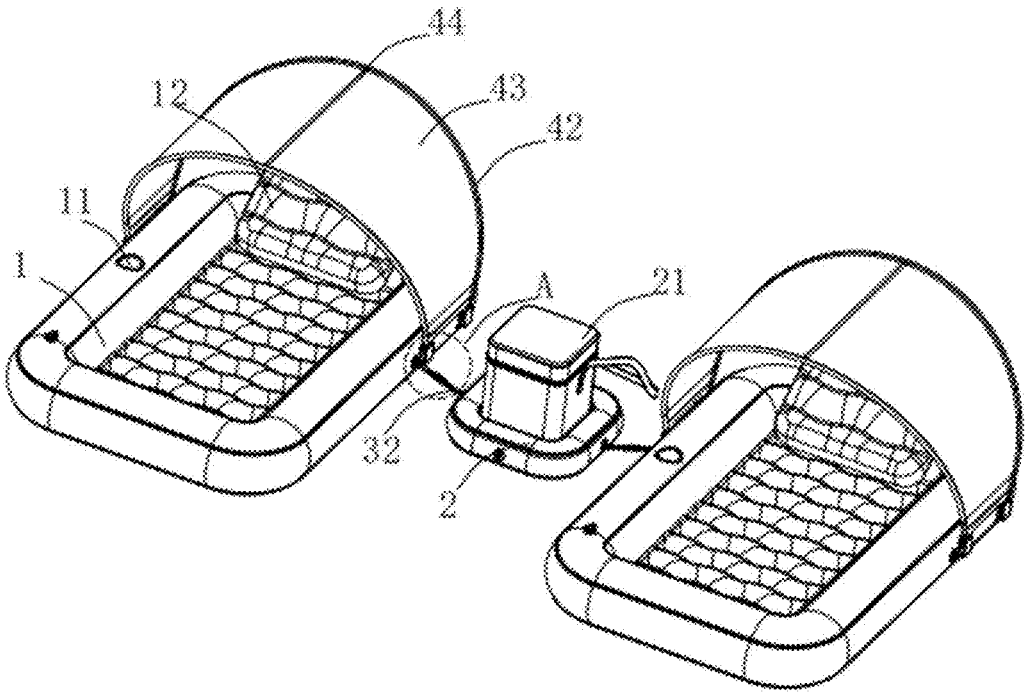
FIG. 1 is a schematic view showing the connection relationship between a floating bed and two adjacent raft bodies in an embodiment of the present application.

The present application is further described in detail below with reference to FIGS. 1-6.

The technical solutions in the embodiments of the present application will be described clearly and completely in combination with the accompanying drawings, the described embodiments are only possible technical implementations of the present application and not all technical implementations. Those skilled in the art may obtain other embodiments without creative labor by means of the embodiments of the present application, and these obtained embodiments are also within the protection scope of the present application. An inventor of the present application finds that an existing inflatable raft has problems such as poor stability and single functionality. Therefore, the present application mainly provides a following inflatable raft that includes a plurality of raft bodies 1 and floating beds 2, a connection assembly 3 is provided between each floating bed 2 and adjacent raft bodies 1 on the left and right thereof. The floating bed 2 carries an ice bucket 21, thereby the enhancing stability and multifunctionality of the inflatable raft, the following is a further detailed description of the present application.

Figure 2:
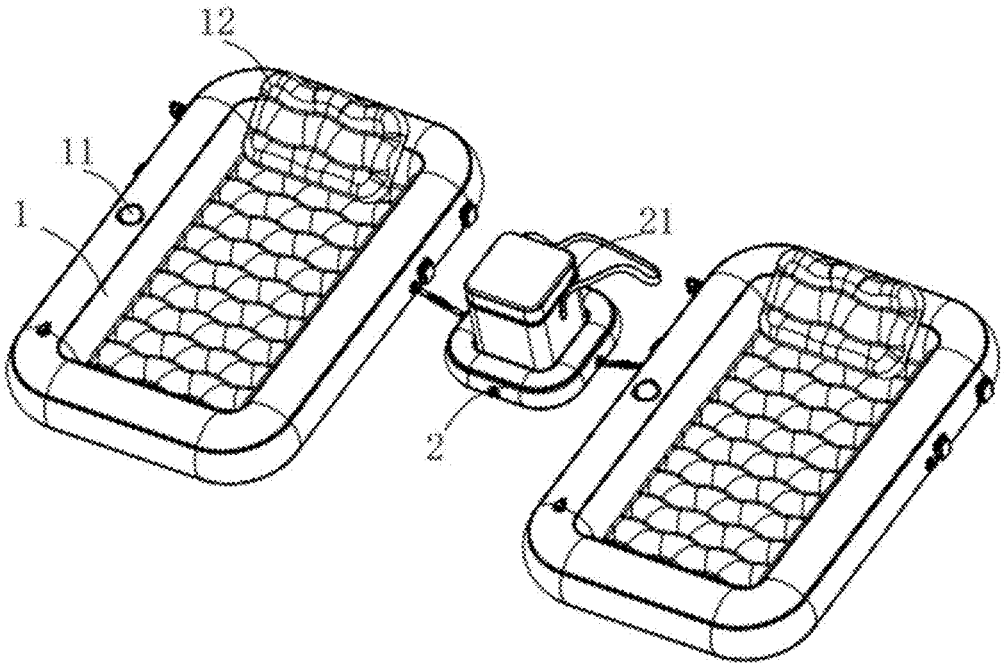
FIG. 2 is a usage state of the embodiment of the present application after removing an awning.
Figure 3:
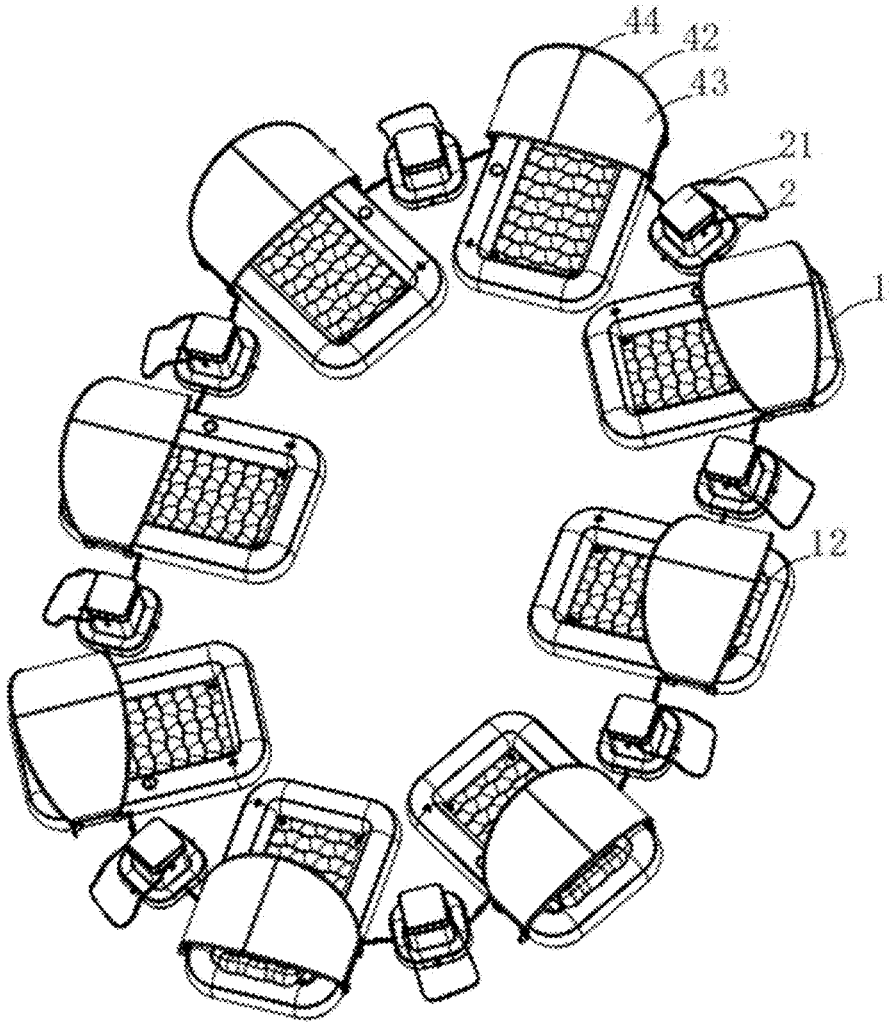
FIG. 3 is a schematic view showing the connection relationship of a plurality of floating beds and raft bodies in the embodiment of the present application.

Referring to FIGS. 1 and 2, the inflatable raft provided in the embodiment of the present application includes the plurality of raft bodies 1 and the plurality of floating beds 2, and a connection assembly 3 is provided between each floating bed 2 and adjacent raft bodies 1 on the left and right thereof. Specifically, the floating bed 2 may be of a hollow cylindrical structure made of high-strength polyethylene material, which has good buoyancy and weather resistance. The floating bed 2 carries the ice bucket 21.

Figure 4:
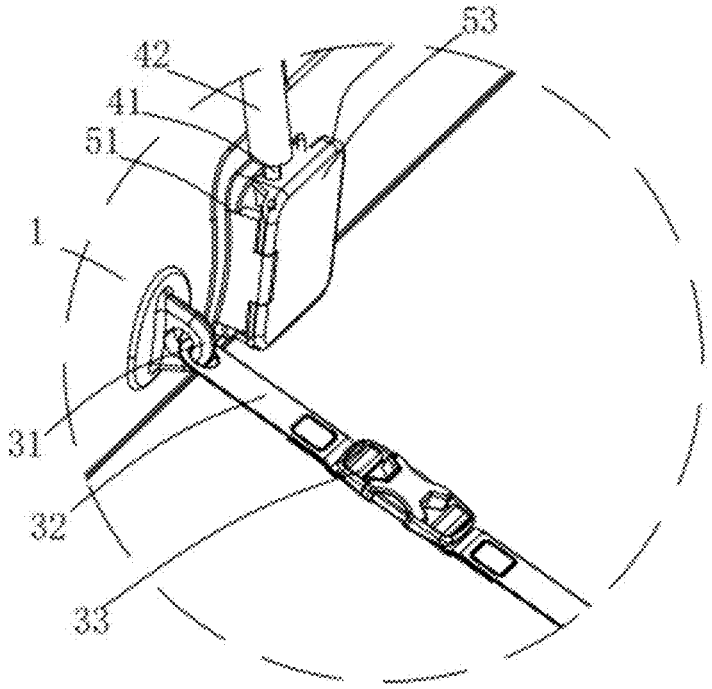
FIG. 4 is an enlarged schematic view of portion A in FIG. 1.

Referring to FIGS. 1 and 4, specifically, the connection assembly 3 includes a snap ring 31, a tension strap 32, and a locking buckle 33, two snap rings 31, two tension straps 32, and two locking buckles 33 are provided. The two snap rings 31 are respectively provided on a side wall of the raft body 1 and a side wall of the floating bed 2, one end of the tension strap 32 is fixed to the snap ring 31, and the other end of the tension strap 32 is fixed to the locking buckle 33, the two locking buckles 33 are interlocked with each other, which improves the stability and multifunctionality of the inflatable raft. Especially, a stable holding of the ice bucket 21 is ensured by the reliable connection assembly 3, thereby improving the user experience.

The snap ring 31 of the connection assembly 3 is made of stainless steel material, which has higher strength and corrosion resistance. The snap ring 31 is fixed to the side wall of the raft body 1 and the side wall of the floating bed 2 by rivets, which ensures a firm connection. The tension strap 32 is made of high-strength nylon material, which has good wear resistance and tensile strength. One end of the tension strap 32 is fixed to the snap ring 31 by sewing or hot melting, and the other end thereof is fixed to the locking buckle 33 through a metal grommet. The locking buckle 33 is made of plastic material, in which a spring-locking mechanism is provided, to ensure the reliability and safety of the locking buckle 33 during use. When the two locking buckles 33 are interlocked with each other, they are automatically locked by an internal spring-locking mechanism to prevent loosening.

The raft body 1 may be of a common inflatable raft structure made of rubber material, which has a good sealing and elasticity. The left side wall and the right side wall of the raft body 1 are embedded with cup holders 11, the cup holders 11 may be made of plastic material, which has certain elasticity and slip resistance, such that beverage bottles or other small items may be firmly fixed. The cup holder 11 is fixed to the side wall of the raft body 1 with adhesive, to ensure the stability during long-term use.

In addition, a top of the raft body 1 may further be provided with a cushion 12, which may be adjusted in angle to meet different requirements for sitting posture of users. The cushion 12 is filled with soft sponge material and is wrapped with waterproof fabric, to provide excellent comfort and durability. The cushion 12 is fixed to the top of the raft body 1 with Velcro or hook and loop fasteners, which may be adjusted in angle and position as needed.

Figure 5:
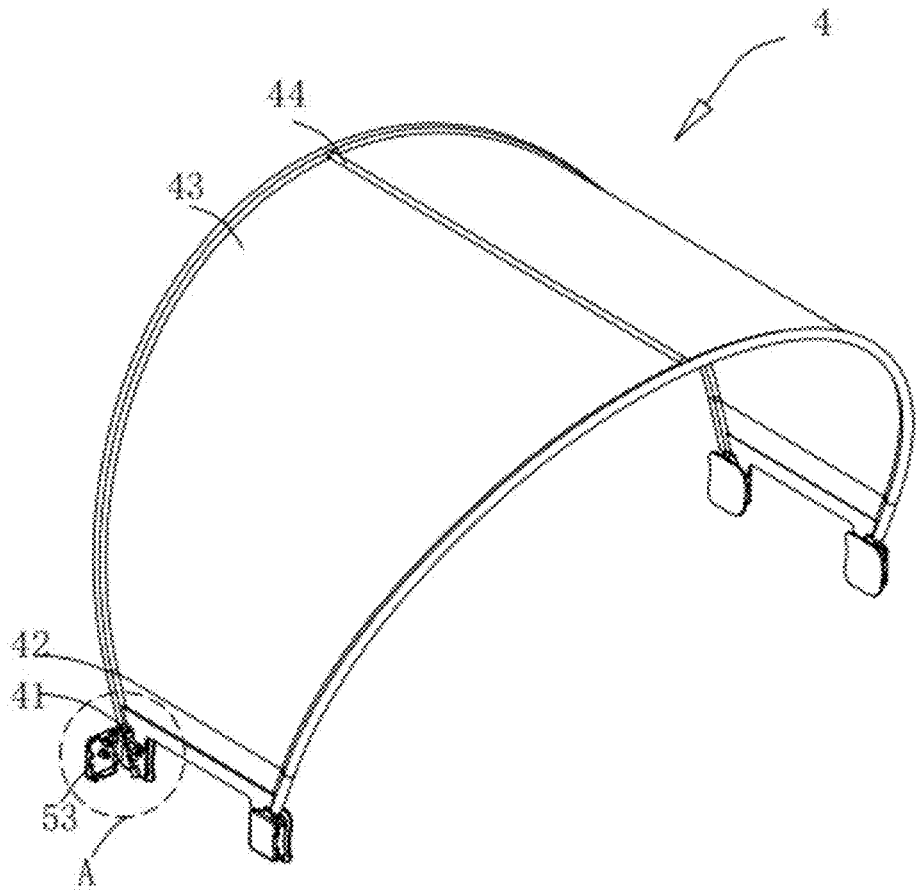
FIG. 5 is the fit between the awning and an installation assembly in the embodiment of the present application.

Referring to FIGS. 1 and 5, on the other hand, the raft body 1 is provided with an awning 4 including a mounting rod 41, a first fiber rod 42 and a PVC sheet 43. Two mounting rods 41 are provided and are arc-shaped. Two ends of the mounting rod 41 are respectively fixed on the left side and right side of the raft body 1. The mounting rod 41 is made of aluminum alloy material, which has characteristics of lightweight and high strength. Two first fiber rods 42 are provided, which encase the mounting rods 41 to enhance structural stability of the awning 4 respectively. The first fiber rod 42 is made of carbon fiber material, which has good rigidity and weight ratio. The PVC sheet 43 is fixed to two adjacent first fiber rods 42 to form a surface sheltered from the sun and rain. The PVC sheet 43 is made of high-strength waterproof material, which has good transmission of light and weather resistance.

Figure 6:
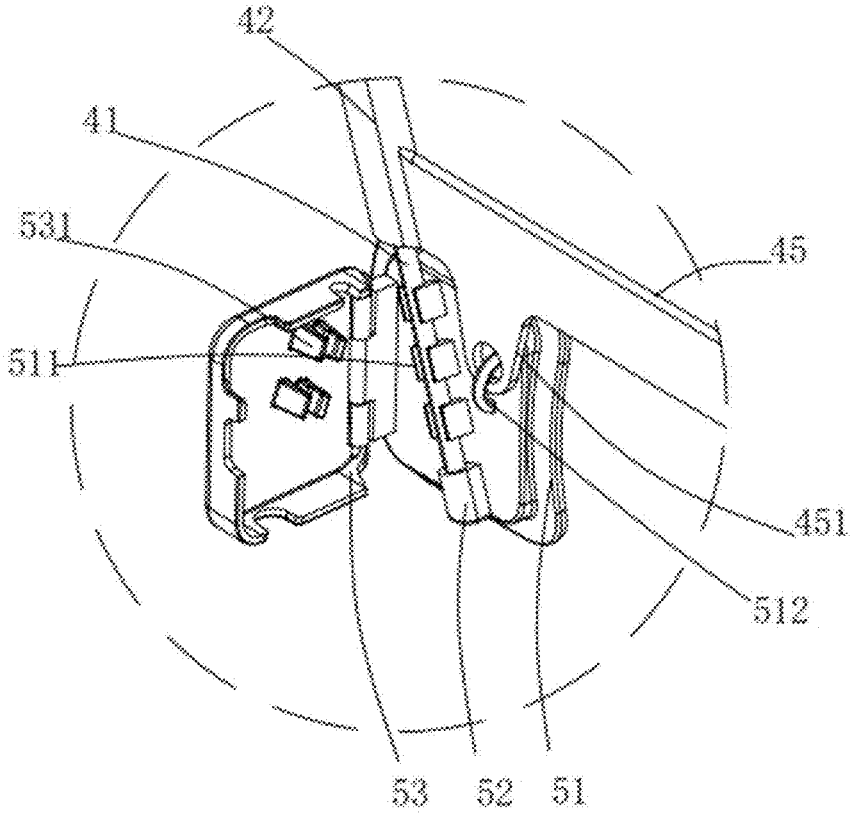
FIG. 6 is an enlarged schematic view of portion A in FIG. 5.

Referring to FIGS. 5 and 6, additionally, the awning 4 further includes a second fiber rod 44, two ends of the second fiber rod 44 are respectively inserted into side walls of the two first fiber rods 42, and the second fiber rod 44 is located in a middle of an arc-shaped surface of the awning 4 for support. The second fiber rod 44 is also made of carbon fiber material, which enhances the structural strength of a middle part of the awning 4, making it more stable.

An installation assembly is provided between the mounting rod 41 and the raft body 1, which includes a mounting base 51 and a socket 52. The mounting base 51 is fixed to the side wall of the raft body 1, and the socket 52 is fixed to a side wall of the mounting base 51, the mounting rod 41 is inserted into the socket 52. The mounting base 51 is made of plastic material, which has good weather resistance and ageing resistance. The socket 52 is internally provided with a spring buckle, ensuring the firmness of the mounting rod 41 after insertion. The mounting base 51 is further provided with a plurality of sets first locking blocks 511, and each set of first locking blocks 511 includes two first locking blocks, side walls of the two first locking blocks 511 respectively abut against two sides of the mounting rod 41 to clamp the mounting rod 41, further improving the stability of installation.

Furthermore, the installation assembly further includes a cover plate 53, which is hinged to the mounting base 51. The cover plate 53 covers the socket 52 and the mounting rod 41. The cover plate 53 is made of plastic material, which has good water resistance and dust resistance. The cover plate 53 is provided with a plurality of sets of second locking blocks 531, each set of second locking blocks 531 is provided with two second locking blocks. When the cover plate 53 covers the mounting base 51, side walls of the two second locking blocks 531 respectively abut against the two sides of the mounting rod 41 to clamp the mounting rod 41, further improving the stability of installation. Additionally, the first locking blocks 511 and the second locking blocks 531 are arranged in cross.

In addition, the awning 4 further includes a fiberboard 45, two fiberboards are provided. The fiberboard 45 is fixed to two adjacent first fiber rods 42 to enhance stability of an edge structure of the awning 4. The fiberboard 45 is made of glass fiber material, which has good rigidity and weight ratio. The mounting base 51 is provided with a hook 512, the fiberboard 45 is fixed with a hanging ring 451, the hanging ring 451 is integrally formed with the fiberboard 45. The hook 512 is hooked on the hanging ring 451 to ensure a secure fixation of the fiberboard 45.

The implementation principle of the inflatable raft in the embodiment of the present application is as follows:

By introducing the floating bed 2 and the connection assembly 3 into the inflatable raft, the stability and multifunctionality of the device is significantly improved. A bracket of the ice bucket 21 on the floating bed 2 may stably hold the ice bucket 21, ensuring the convenience and safety during use. The connection assembly 3 adopts a design of the snap ring 31, the tension strap 32 and the locking buckle 33, which not only improves a reliability of the connection, but also facilitates a quick assembly and disassembly of users. The cup holder 11 and the adjustable cushion 12 on the raft body 1 further enhance comfort and practicality of the device, meeting diverse needs of users. In summary, the inflatable raft may be efficiently applied in outdoor leisure devices through reasonable structural design and material selection of the embodiment of the present application, improving the user experience.

The above are the optional embodiments of the present application, which are not intended to limit the protection scope of the present application. Therefore, all equivalent changes made according to the structure, shape and principle of the present application should be covered within the protection scope of the present application.

LIST OF REFERENCE NUMERALS 1 raft body
11 cup holder

12 cushion
2 floating bed
21 ice bucket
3 connection assembly
31 snap ring
32 tension strap
33 locking buckle
4 awning
41 mounting rod
42 first fiber rod
43 PVC sheet
44 second fiber rod
45 fiberboard
451 hanging ring
51 mounting base
511 first locking block
512 hook
52 socket
53 cover plate
531 second locking block

What is claimed is:

1. An inflatable raft, comprising at least one raft body and at least one floating bed, wherein a connection assembly is provided between each of the at least one floating bed and a respective one of the at least one raft body, an ice bucket is provided on each of the at least one floating bed, the connection assembly comprises two snap rings, two tension straps and two locking buckles, the two snap rings are respectively provided on a side wall of each of the at least one floating bed and a side wall of the respective one of the at least one raft body, a first end of each of the two tension straps is fixed to one of the two snap rings, a second end of each of the two tension straps is fixed to one of the two locking buckles, and the two locking buckles are interlocked with each other, wherein each of the at least one raft body is provided with an awning, the awning comprises two mounting rods, two first fiber rods and a polyvinyl chloride (PVC) sheet, the two mounting rods are each configured in an arc shape, two ends of each of the two mounting rods are respectively fixed on two sides of each of the at least one raft body, the two first fiber rods encase the two mounting rods respectively, and the PVC sheet is fixed to the two first fiber rods, and the awning further comprises a second fiber rod, two ends of the second fiber rod are respectively inserted into side walls of the two first fiber rods, and the second fiber rod is located in a middle of an arc-shaped surface of the awning to form a support.

2. The inflatable raft according to claim 1, wherein side walls of the at least one raft body are embedded with cup holders.

3. The inflatable raft according to claim 1, wherein a top of the at least one raft body is provided with a cushion, and an angle of the cushion is adjustable.

4. The inflatable raft according to claim 1, wherein the at least one floating bed is two or more floating beds, and the at least one raft body is-two or more raft bodies.

5. An inflatable raft, comprising at least one raft body and at least one floating bed, wherein a connection assembly is provided between each of the at least one floating bed and a respective one of the at least one raft body, an ice bucket is provided on each of the at least one floating bed, the connection assembly comprises two snap rings, two tension straps and two locking buckles, the two snap rings are respectively provided on a side wall of each of the at least one floating bed and a side wall of the respective one of the at least one raft body, a first end of each of the two tension straps is fixed to one of the two snap rings, a second end of each of the two tension straps is fixed to one of the two locking buckles, and the two locking buckles are interlocked with each other, wherein each of the at least one raft body is provided with an awning, the awning comprises two mounting rods, two first fiber rods and a polyvinyl chloride (PVC) sheet, the two mounting rods are each configured in an arc shape, two ends of each of the two mounting rods are respectively fixed on two sides of each of the at least one raft body, the two first fiber rods encase the two mounting rods respectively, and the PVC sheet is fixed to the two first fiber rods, wherein an installation assembly is provided between each of the two mounting rods and the respective one of the at least one raft body, the installation assembly comprises a mounting base and a socket, the mounting base is fixed to the side wall of the respective one of the at least one raft body, the socket is fixed to a side wall of the mounting base, and each of the two mounting rods is disposed in the socket, and inflatable raft according to claim 4, wherein the installation assembly further comprises a cover plate, the cover plate is hinged to the mounting base, and the cover plate covers the socket and a respective one of the two mounting rods.

6. The inflatable raft according to claim 5, wherein the mounting base is provided with a plurality of sets of first locking blocks, each set of the plurality of sets of first locking blocks is provided with two first locking blocks, and side walls of the two first locking blocks respectively abut against two sides of the respective one of the two mounting rods to clamp the respective one of the two mounting rods.

7. The inflatable raft according to claim 5, wherein the cover plate is provided with a plurality of sets of second locking blocks, each set of the plurality of sets of second locking blocks is provided with two second locking blocks, and when the cover plate covers the mounting base, side walls of the two second locking blocks respectively abut against two sides of the respective one of the two mounting rods to clamp the respective one of the two mounting rods.

8. The inflatable raft according to claim 5, wherein the awning further comprises two fiberboards, the two fiberboards are fixed to the two first fiber rods, the mounting base is provided with a hook, each of the two fiberboards is fixed with a hanging ring, and the hook is hooked on the hanging ring.

* * * * *